US006006619A

United States Patent [19]

Gindentuller et al.

[11] Patent Number: 6,006,619

[45] Date of Patent: Dec. 28, 1999

[54] INTERNAL COMBUSTION ENGINE WITH IMPROVED ORBITAL CRANKSHAFT MOTION CONVERTER

[76] Inventors: Ilya Gindentuller, 220 Ave. H, Apt. H, Redondo Beach, Calif. 90277; Steve Ruiz, 2123 Belmont La., Redondo, Calif. 90278

[21] Appl. No.: 09/057,964

[22] Filed: Apr. 9, 1998

[51] Int. Cl.[6] ..... F02B 75/32

[52] U.S. Cl. ..... 74/44; 74/52; 123/197.1

[58] Field of Search ..... 74/44, 49, 52; 123/197.4, 52.4, 52.6, 53.2, 197.1

[56] References Cited

U.S. PATENT DOCUMENTS

| | | | |
|---|---|---|---|
| 587,380 | 8/1897 | Ziegler | 74/52 |
| 1,210,861 | 1/1917 | Sitney | 74/52 |
| 3,290,950 | 12/1966 | Carlson | 74/52 |
| 3,886,805 | 6/1975 | Koderman | 123/197.4 |
| 4,179,942 | 12/1979 | Matthews | 74/52 |
| 5,067,456 | 11/1991 | Beachley et al. | 123/197.4 |
| 5,212,996 | 5/1993 | Mery | 74/49 |
| 5,782,213 | 7/1998 | Pedersen et al. | 123/55.2 |

FOREIGN PATENT DOCUMENTS

| | | | |
|---|---|---|---|
| 776882 | 2/1935 | France | 74/52 |
| 373119 | of 1939 | Italy | 74/52 |
| 353593 | 5/1961 | Sweden | 74/52 |
| 2103755 | 2/1983 | United Kingdom | 74/52 |

*Primary Examiner*—Tamara L. Graysay
*Assistant Examiner*—William C Joyce
*Attorney, Agent, or Firm*—Loeb & Loeb LLP

[57] ABSTRACT

An engine or like apparatus includes a linear-to-rotational motion converting mechanism which emulates an elliptic trammel or ellipsogragh linkage. The apparatus includes at least one cylinder disposed along a first axis and a piston reciprocable in the at least one cylinder along the first axis. Also included is an orbital crankshaft having a piston crank and an orbital shaft, the piston crank having a first end journaled to the piston and a second end, the second end being secured to the orbital shaft, the orbital shaft extending along a second axis perpendicular to the first axis. An output crank has a first end and a second end, the first end of the output crank being journaled to the orbital shaft. An output shaft is secured to the second end of the output crank, the output shaft being rotatable at an angular velocity about a third axis parallel with the second axis and perpendicular to and intersecting the first axis. A timing unit is coupled to the orbital shaft, the timing unit constraining the orbital shaft to rotate about the second axis at an angular velocity equal and opposite to that of the angular velocity of the output shaft. The timing unit includes an epicyclic gear train having one or, preferably, two stages.

1 Claim, 10 Drawing Sheets

INTERNAL COMBUSTION ENGINE WITH IMPROVED ORBITAL CRANKSHAFT MOTION CONVERTER

BACKGROUND OF THE INVENTION

1. Field of the Invention

The present invention relates to internal combustion engines and like apparatus which includes a mechanism for converting the reciprocating motion of one or more pistons into rotational motion of an output element, and in which the motion converting mechanism emulates an elliptic trammel type or "ellipsograph" linkage.

2. Description of the Prior Art

As is well known, conventional internal combustion engines utilize piston rod and crank mechanisms for converting the reciprocating motion of the pistons into rotational motion of an output shaft. Such conventional mechanisms have certain drawbacks. For example, the piston and cylinder wall surfaces wear substantially as a result of side thrust forces. These side forces may also cause significant power losses due to friction. Piston/cylinder mismatches may also cause jamming of the pistons. Moreover, these conventional engines often lack appropriate balancing means, so that non-balanced, secondary inertial forces constrain the angular velocity of the output shaft thereby limiting increases in power output. Still further, conventional crankshafts tend to be massive, reflecting the strength that is built into them in order to handle full output torque. Durability is sometimes compromised because of insufficient lubrication of the pistons working in a high-temperature environment.

A known alternative to the conventional piston rod and crank internal combustion engine (ICE) utilizes an elliptic trammel linkage, or "ellipsograph" mechanism for converting the reciprocating motion of the pistons into rotational motion of an output shaft. An improved version of an ICE incorporating such a mechanism is disclosed in U.S. Pat. No. 5,189,994 issued Mar. 2, 1993 and incorporated herein by reference. FIG. 1 of the prior art '994 patent, which figure has been reproduced as FIG. 1 herein, shows a two-dimensional schematic representation of an engine 10 employing the "ellipsograph" principle. The engine 10 includes an engine block or casing 12 carrying a crankshaft bearing 14. The casing 12 defines a horizontal cylinder 16 and a vertical cylinder 18 disposed orthogonally relative to each other along an X axis and a Y axis, respectively. The cylinders 16 and 18 are provided with intake and exhaust valves 19. Pistons 20 and 22 are received for reciprocation within the cylinders 16 and 18, respectively. A connecting rod 24 couples the piston 20 with a horizontal guide in the form of a slide 26 movable within a linear guideway 28 aligned with the X axis; similarly, a connecting rod 30 couples the piston 22 with a vertical guide in the form of a slide 32 movable within a linear guideway 34 disposed along the Y axis. A link or orbital crankshaft 36 connects the slides 26 and 32 at end points 38 and 40. Last, a power output crank 42 having one end connected to the midpoint 44 of the orbital crankshaft 36 and its other end journaled in the bearing 14, is rotatable about a central point 46 lying on a longitudinal Z axis mutually orthogonal to the X and Y axes. It will be evident that the two-dimensional mechanism of FIG. 1 is theoretical only; for example, the intersecting guideways 28 and 34 would preclude realization of a practical engine which would require that the guideways be offset along the Z axis.

In the operation of the engine shown schematically in prior art FIG. 1, as the pistons 20 and 22 reciprocate in their respective cylinders and with the pistons alternately reaching their top and bottom dead centers, the ends 38 and 40 of the orbital crankshaft reciprocate between their horizontal and vertical endpoints equidistant from the Z axis represented by the point 46. The output crank 42 is thereby driven with an angular velocity, $\omega$, with the point 44 describing a circle centered on the Z axis. At the same time, the orthogonally disposed, linear slides and guides together with the crank 42, constrain the orbital crankshaft 36 to counterrotate at an angular velocity of $-\omega$ about an axis passing through the point 44.

As explained in the '994 patent, IC engines employing the principles of that patent have significant advantages. Nevertheless, the slide/guide arrangement disclosed in the '994 patent has been found to have several drawbacks. For example:

(a) the alignment requirements imposed by the slide/guide arrangement result in difficulties in packaging the engine crankcase;

(b) significant side loads produced within the slide-guide mechanisms result in friction losses, especially at high rpm, approaching those encountered in conventional piston/crank IC engines;

(c) pressurized lubrication of the slide/guide arrangement requires a high capacity, high pressure oil pump that is costly and consumes substantial power and it is moreover difficult to retain sufficient oil within the fast moving slide/guide mechanism to adequately lubricate that mechanism; and (d) the mass of the reciprocating slide-guide mechanisms is substantial and precludes reducing the total mass of the moving parts to below that of conventional IC engines.

Thus, although relatively slow, large engines such as those used for marine applications may successfully use the principles of the '994 patent, the foregoing drawbacks render ICEs employing the slide/guide arrangement of the '994 patent uncompetitive with present high rpm conventional engines used, for example, to power passenger vehicles.

Accordingly, it is an overall object of the present invention to provide an ICE or like apparatus that eliminates dependency on the slide/guide arrangement of known elliptic trammel type linkages while preserving the benefits of such mechanisms.

SUMMARY OF THE INVENTION

Basically, the present invention is predicated on the fact that the elliptic trammel and slide-guide mechanism of the '994 patent compels the orbital crankshaft and output shaft of the engine to counterrotate at the same angular velocity, $\omega$. The present invention preserves that fundamental angular velocity relationship while eliminating the slide/guide elements.

In accordance with the broad aspects of the present invention, the orbital crankshaft of the engine is coupled to a low friction, mechanically efficient timing unit that performs the function of the slide/guide elements of the prior art but does not have the drawbacks thereof. In accordance with one embodiment of the invention, the timing unit includes an epicyclic gear train which forces the orbital crankshaft and output shaft of the engine to counterrotate at the same angular velocity, $\omega$. In acordance with a second, preferred embodiment, the timing unit comprises the series combination of two epicyclic gear trains. The dual stage epicyclic gear train timing unit achieves several goals: it forces the orbital crankshaft to rotate uniformly with an angular velocity, −ω, thus achieving linear motion of the pistons; removes limitations on gear sizes; allows for backlash control via choice of gear sizes; and allows for timing setup by providing for the adjustability of the angular position of a fixed ring gear forming part of the gear train.

BRIEF DESCRIPTION OF THE DRAWINGS

Further objects, features and advantages of the invention will become evident from the ensuing detailed description when taken in conjunction with the accompanying drawings in which.

DETAILED DESCRIPTIONS OF THE PREFERRED EMBODIMENTS

It is to be understood that the preferred embodiments described herein merely exemplify the invention which may take forms different from the specific embodiments described. For example, while the detailed descriptions of the preferred embodiments are directed principally to internal combustion engines, it is to be understood that the principles of the invention are equally applicable to engines driven hydraulically or pneumatically, as well as to pumps and compressors, and that the appended claims are intended to encompass such alternative apparatus.

Figure 1:
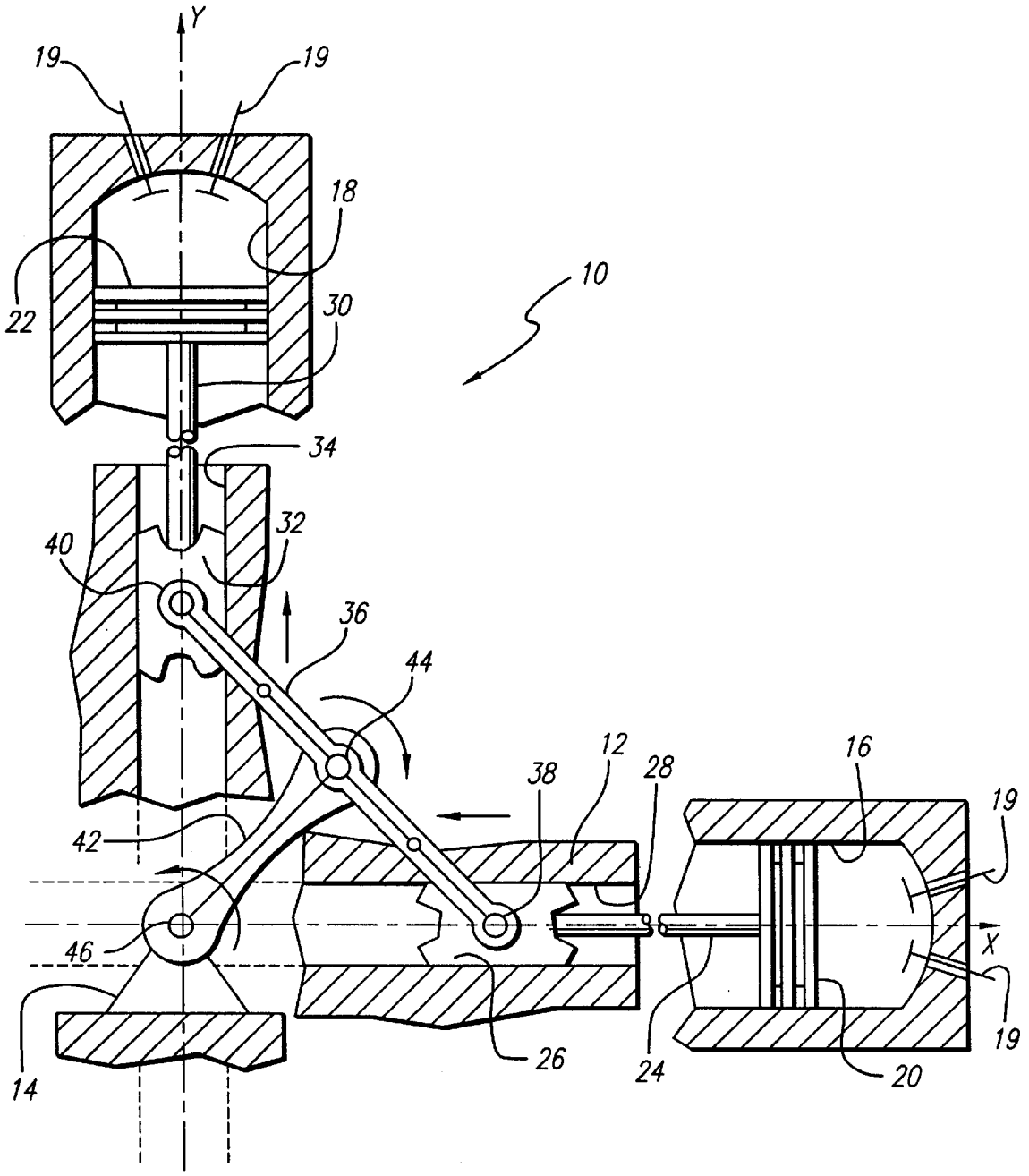
FIG. 1 PRIOR ART
FIG. 1 is an end elevation view of a two-dimensional, schematic representation of an internal combustion engine illustrating the principles of the ellipsograph mechanism in accordance with the prior art.
Figure 2:
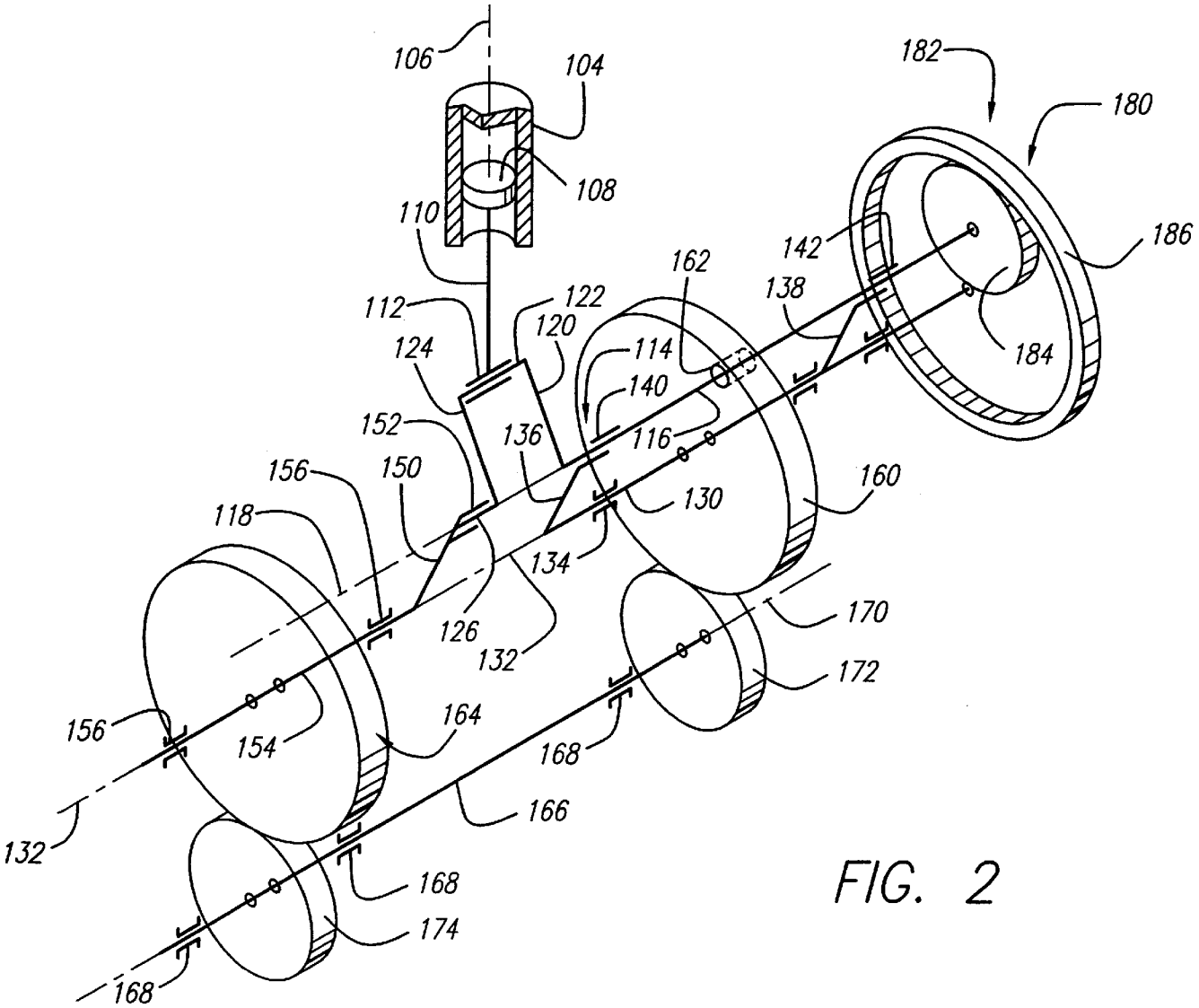
FIG. 2 is a schematic perspective view of a first embodiment of an ICE in accordance with the present invention.
Figure 3:
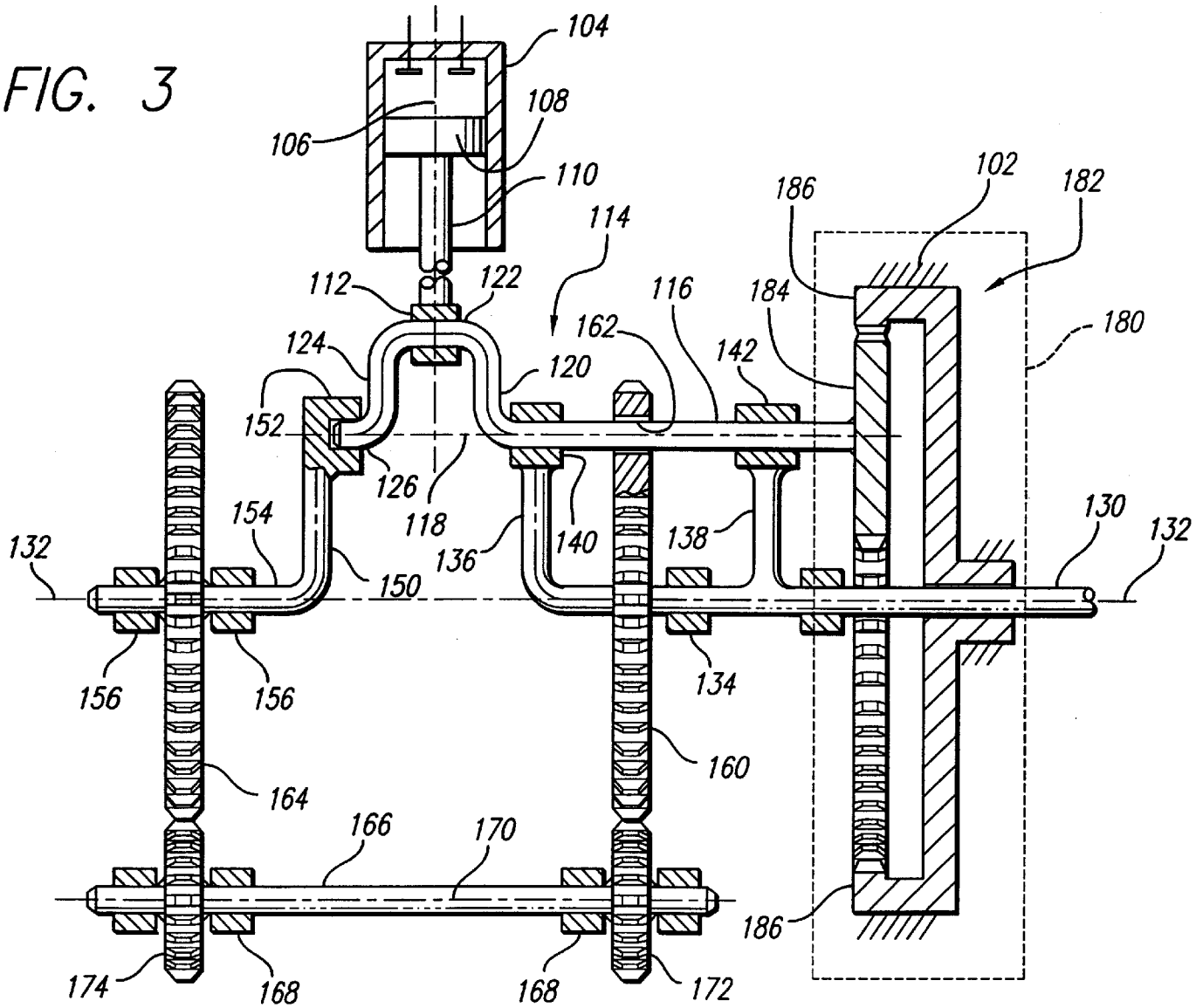
FIG. 3 is a schematic side view of the apparatus shown in FIG. 2.

FIGS. 2 and 3 show, in schematic form, a first embodiment of the invention. In the first embodiment, an engine 100 includes a casing 102 defining a cylinder 104 extending along a transversely extending, first axis 106. It will be understood that in practice, the cylinder 104 would preferably be one of a pair of opposed cylinders aligned along the axis 106. The cylinder 104 contains a reciprocable piston 108 having fixed thereto a connecting rod 110 terminating in a bearing 112. The engine 100 further includes an orbital crankshaft 114 including an orbital shaft 116 extending along a longitudinal orbital axis 118, a crank 120, and a crank pin 122 carried by the outer end of the crank 120. The crank pin 122 is journaled in the connecting rod bearing 112. The orbital crankshaft 114 further includes an end crank 124 terminating in a stub shaft 126 disposed along the longitudinal orbital axis 118.

The engine 100 further includes an output shaft 130 extending along a fixed longitudinal axis 132 perpendicular to and intersecting the axis 106 and parallel with the orbital axis 118 of the orbital crankshaft 114. The output shaft 130 is journaled for rotation in bearings 134 carried by the engine casing 102. Affixed to the output shaft 130 are a pair of parallel, transversely extending cranks 136 and 138 having ends including longitudinally aligned bearings 140 and 142, respectively. The shaft 116 of the orbital crankshaft 114 is journaled for rotation in the bearing 140 and 142.

The engine 100 further includes an end crank 150 including at the outer end thereof a bearing 152 that receives the stub shaft 126 and thereby supports and guides the motion of the orbital crankshaft 114. The inner end of the end crank 150 is secured to a longitudinal end shaft 154 extending along the axis 132 and journaled for rotation in bearings 156 carried by the engine casing 102.

Secured to the output shaft 130 is a gear 160 having adjacent its periphery a longitudinally extending bearing 162 within which the shaft 116 is journaled. A gear 164, having the same diameter as the gear 160 and disposed coaxial therewith, is affixed to the end shaft 154. The apparatus further includes a shaft 166 supported by bearings 168 along an axis 170 offset from and parallel with the output shaft axis 132. Attached to the shaft 166 are a pair of spaced apart gears 172 and 174 in mesh with the gears 160 and 164, respectively. The gear sets 160/172 and 164/174 serve both to synchronize the rotation of the orbital crankshaft 114 and output shaft 130 and to maintain the precise alignment of those elements along their respective axes. Any tendency for those components to jam is thereby eliminated. It will also be seen that the shaft 166 may be used as the main, or as an auxiliary, power output shaft.

As taught by the '994 patent, counterweights (not shown) may be included as extensions to the various crank components of the engine 100 to compensate for inertial forces and unbalanced moments.

The engine 100 also includes a timing unit whose principal function is to emulate the motion constraints imposed by the slide/guide arrangement of the prior art '994 patent. Specifically, the timing unit compels the orbital crankshaft 114 to rotate uniformly at an angular velocity of −ω radians/second while the output shaft 130 counterrotates at an equal but opposite angular velocity of ω radians/second. That relationship between angular velocities is the essence of the conversion of the linear motion of the piston rod bearing 112 along the transverse axis 106 to rotation of the orbital crankshaft 114 about the longitudinal orbital axis 118. Two embodiments of the timing unit will be described, although it will be evident to those skilled in the art that the timing unit may take other forms. The first embodiment of the timing unit, designated by the reference numeral 180, is shown in FIGS. 2 and 3; it basically comprises an epicyclic gear train 182 including a rotatable spur gear 184 in mesh with an internally toothed ring gear 186 fixed to the engine casing 102 concentric with the axis 132. The spur gear 184 is fixedly secured to an end 188 of the shaft 116. In well known fashion, the spur gear 184 has a motion compounded of rotation about the axis 118 and a translation or revolution of that axis about the axis 132. For the required relationship between the angular velocities of the orbital crankshaft 114 and output shaft 130, the following relationship must be observed:

$$r2 = \frac{r1}{2} = \frac{s}{4}, \quad \text{where}$$

r1 is the radius of the fixed ring gear 186;

r2 is the radius of the rotatable spur gear 184; and s is the stroke length of the piston 108.

When the foregoing relationship is observed, the ratio of the angular velocity, ω, of the output shaft 130 to the angular velocity, −ω, of the orbital crankshaft 114 will be the required −1.

The first embodiment of the timing unit 180, although providing a simple solution, is practical only for low power, relatively long stroke engine applications. This is because the relatively short strokes of modern high speed engines result in correspondingly small values of the radius, r2, of the spur gear 184. If the gear 184 is too small, it might not be able to transmit the torque imposed on it. Further, a small value of r2 can result in an unacceptable degree of backlash.

Figure 4:
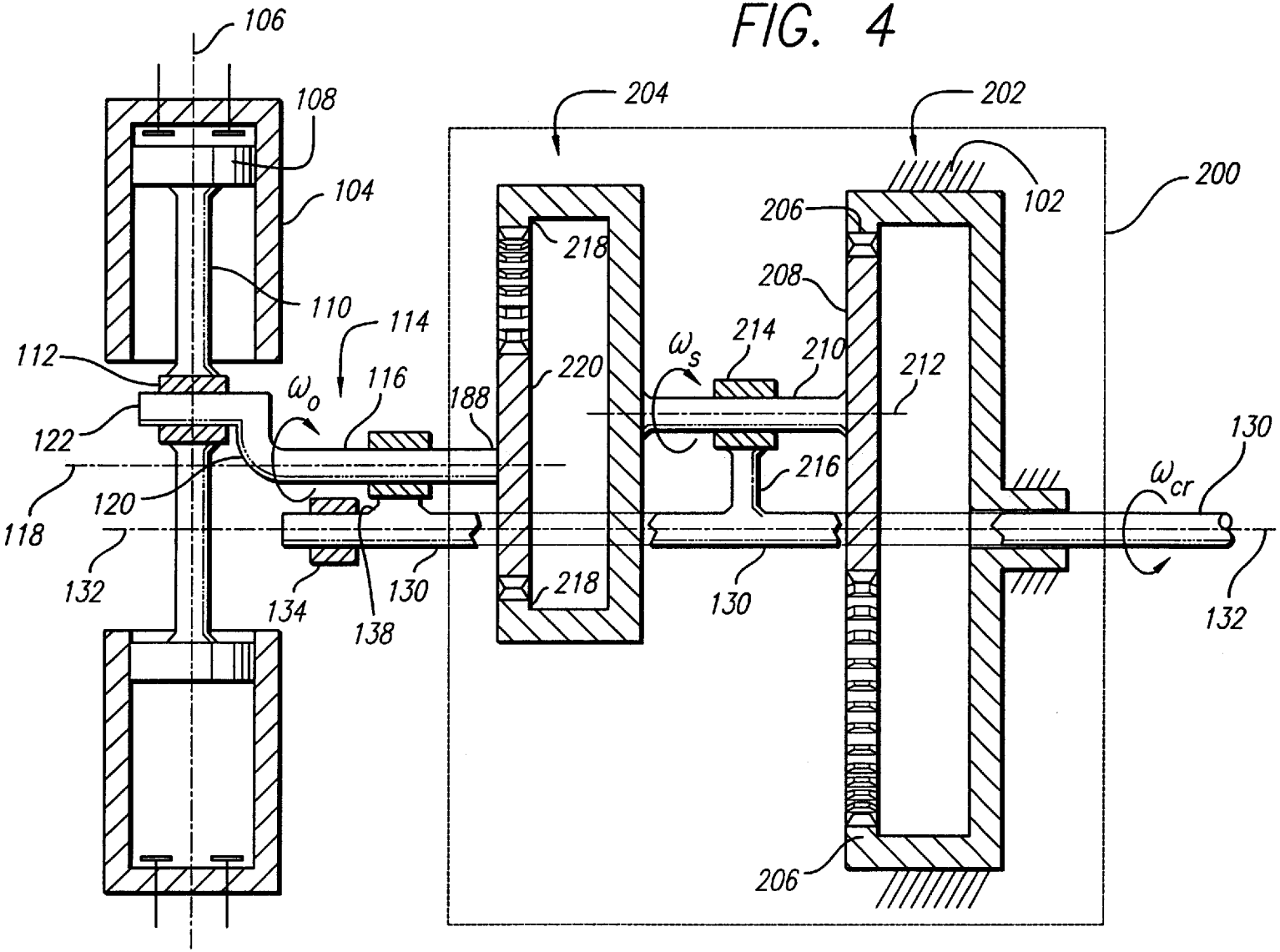
FIG. 4 is a schematic side view of a second embodiment of an ICE in accordance with the present invention.

The second or preferred embodiment of the timing unit, identified by the reference numeral 200, is shown in FIG. 4. The timing unit 200 has two stages and includes the series combination of a first epicyclic gear train 202 and a second epicyclic gear train 204. The first stage 202, as in the timing unit 180 of the first embodiment, includes an internally toothed ring gear 206, concentric with the axis 132, secured to the engine casing 102 and a spur gear 208 in mesh with the ring gear 206. Unlike the spur gear 184 in the first embodiment, however, the spur gear 208 has a rl relatively large diameter $$\left(\text{greater than } \frac{r1}{2}\right)$$

so that it rotates at an angular velocity, $\omega_s$, which is less than $\overline{\omega}$. The gear 208 is secured to one end of a shaft 210 journaled for rotation about an axis 212 in a bearing 214 on the outer end of a crank arm 216 attached to the output shaft 130. The other end of the shaft 210 carries an internally toothed, rotatable ring gear 218 which, together with a spur gear 220 in mesh with the ring gear 218, comprise the epicyclic gear train 204. The spur gear 220 is mounted on the end 188 of the shaft 116. It will be seen that the spur gear 208 and the rotatable ring gear 218 joined therewith will have a motion compounded of rotation about the axis 212 and translation or revolution of the axis 212 about the axis 132.

Where:

ro is the length of the crank 120;

r1 is the radius of the fixed ring gear 206;

r2 is the radius of the spur gear 208;

r3 is the radius of rotatable ring gear 218;

r4 is the radius of the spur gear 220;

r5 is the length of the crank 216;

$w_o$ is the angular velocity of the orbital crankshaft 114 about the axis 118;

$w_s$ is the angular velocity about the axis 212 of the assembly comprising the spur gear 208, the shaft 210 and the ring gear 218; and $w_{cr}$ is the angular velocity of the output shaft 130, and letting:

$$K_{12}=1-r1/r2, \text{ and}$$

$$K_{34}=r3/r4, \text{ then}$$

the following relationships can be written:

$$\omega_s=\omega_{cr}*K_{12};$$

$$\omega_o=\omega_s*K_{34}; \text{ and}$$

$$\omega_o=\omega_{cr}*K_{12}*K_{34}.$$

Since the goal is to have $\omega_o=-\omega_{cr}$, then the last relation can be rewritten as:

$$K_{12}=-(1/K_{34}). \quad (1)$$

As follows directly from the geometry of the apparatus shown in FIG. 4:

$$r_s=r0+r3-r4 \quad (2)$$

and also $$r_s=r1-r2 \quad (3)$$

and, by definition $$r0=S/4 \quad (4)$$

To determine r1 and r2 in case that r3 and r4 and r0 are known we must write a system of simple equations that follows directly from (1) and (3):

$$r1-r2=r_s;$$

$$1-r1/r2=-(r4/r3)$$

Solving that system relative to r1, r2 and using (2) we obtain final system of equations:

$$r_s=r0+r3-r4;$$

$$r1=(r0+r3-r4)*(1+r3/r4);$$

$$r2=(r0+r3-r4)*(r3/r4).$$

It will be evident from the foregoing that all possible sizes of gears 206, 208, 218 and 220 that yield $\omega_o=-\omega_{cr}$ can be readily calculated. In accordance with one example, based on a piston stroke, S, of 3.0 inches, a crank 120 having a length, r0, of S/4=0.75 inch, and selecting values of r4 and r3 of 1.0 inch and 1.5 inches, respectively, the following values are obtained: $r_s$=1.25 inches; $r_1$=3.125 inches; and $r_2$=1.875 inches.

The angular position of the fixed ring gears 186 and 206 may be adjusted to set engine timing.

Figure 5:
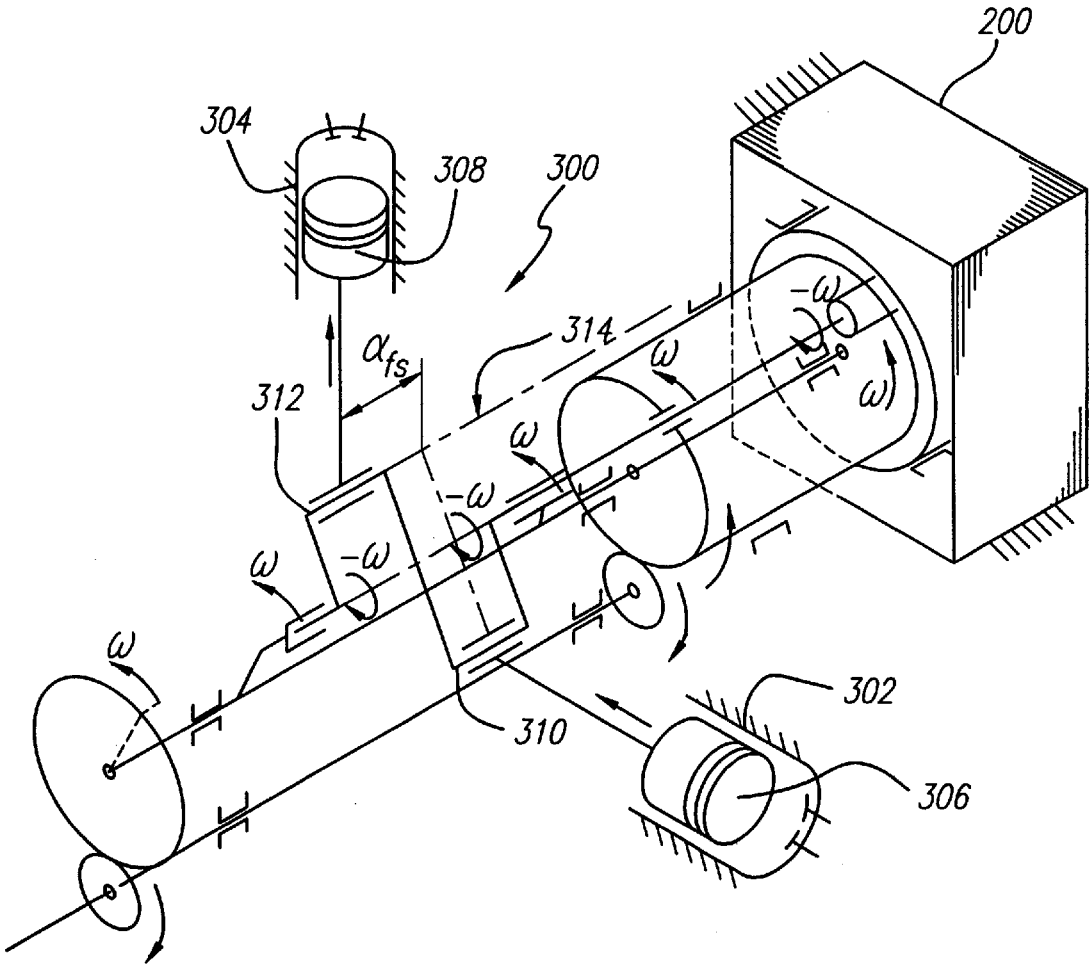
FIGS. 5, 6 and 7 are schematic perspective views of third, fourth and fifth embodiments of ICEs in accordance with the present invention.
Figure 6:
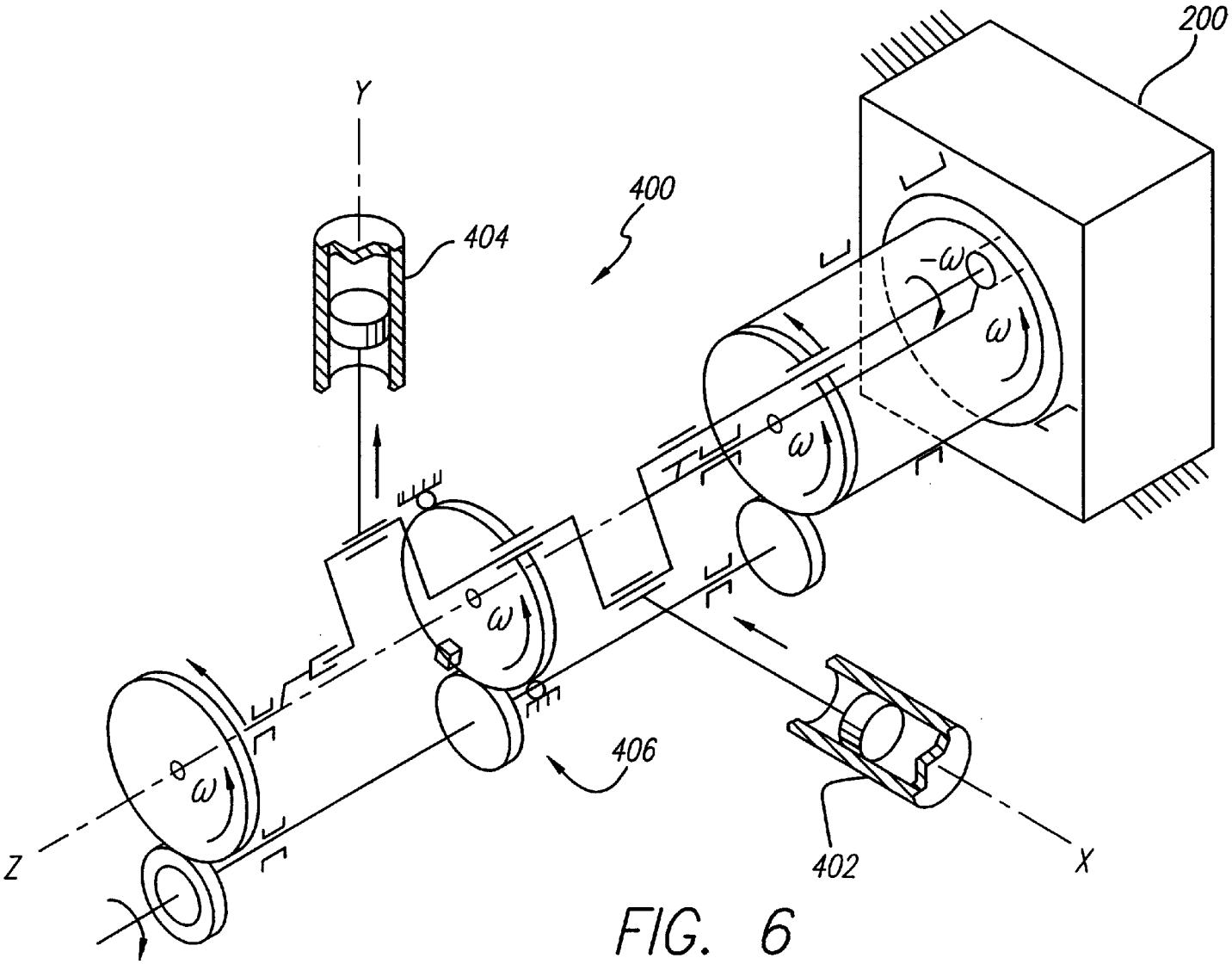
Figure 7:
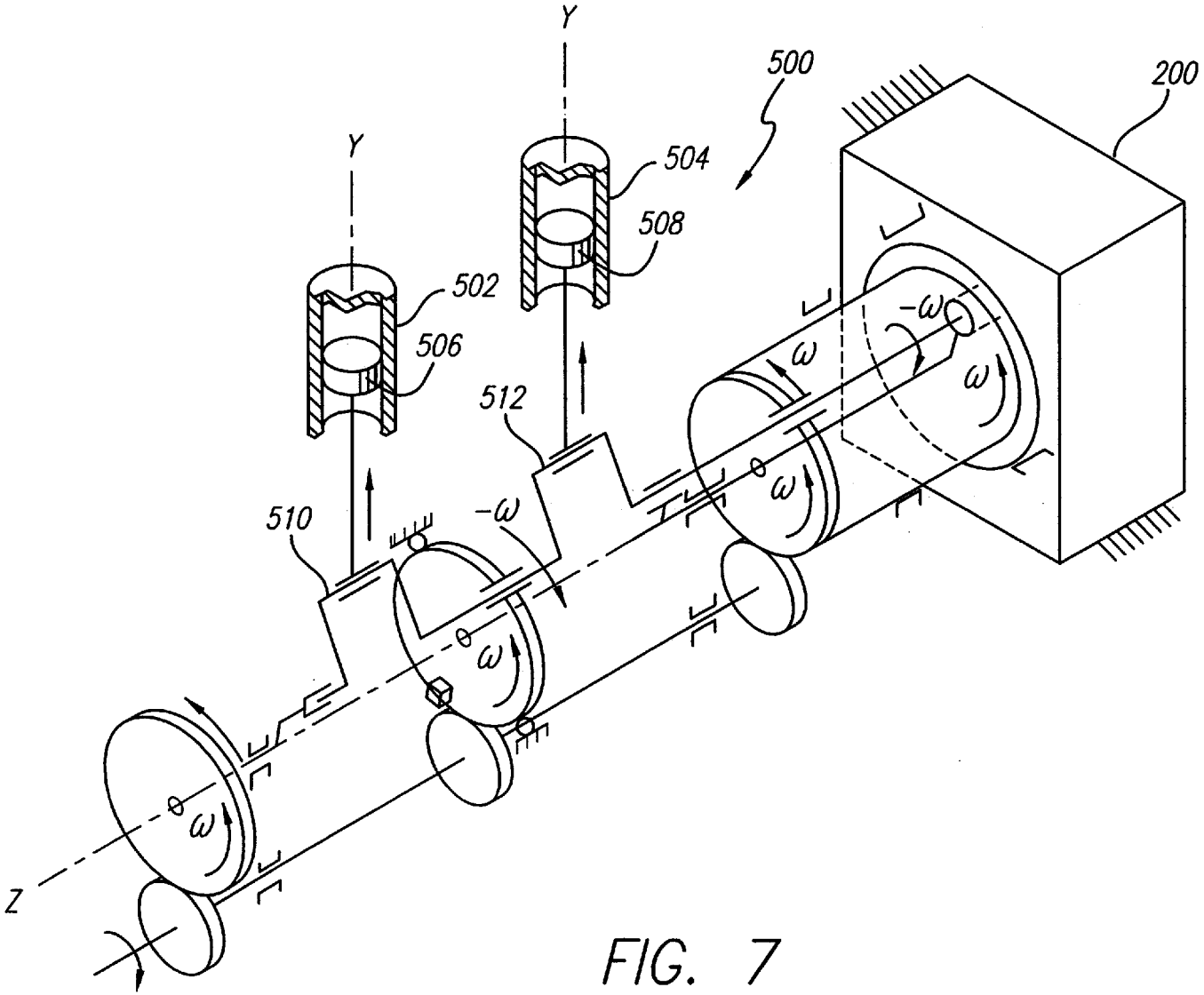

FIGS. 5–7 show, in schematic form, additional embodiments of the engine of the present invention. Each of these embodiments preferably employs the dual stage timing unit 200; the embodiments differ only in the orientation and longitudinal spacing of the cylinders.

Thus, FIG. 5 (which is similar to FIG. 7 of the '994 patent) shows an engine 300 having opposed axially spaced pairs of horizontal and vertical cylinders, 302 and 304, respectively. (For clarity, only one of each of the pairs of cylinders is shown.) Pistons 306 and 308 in the cylinders 302 and 304 are connected to opposed crank pins 310 and 312 forming parts of an orbital crankshaft 314.

The engine 400 of FIG. 6 (corresponding to that shown in FIG. 2 of the '994 patent) is similar to the engine 300 of FIG. 5 except that the pairs of horizontal and vertical cylinders 402 and 404 are spaced apart axially a greater distance than the cylinders 302 and 304. The engine 400 further includes a central crank and gear assembly 406 permitting the generation and transmission of higher torque and power levels.

FIG. 7 shows another variation comprising an engine 500 including horizontally opposed pairs of cylinders 502 and 504 (again, for clarity only one cylinder of each pair is shown). Pistons 506 and 508 in the cylinders 502 and 504 are connected to crank pins 510 and 512 in alignment with each other rather than being orthogonal as in the engines 300 and 400.

Figure 8A:
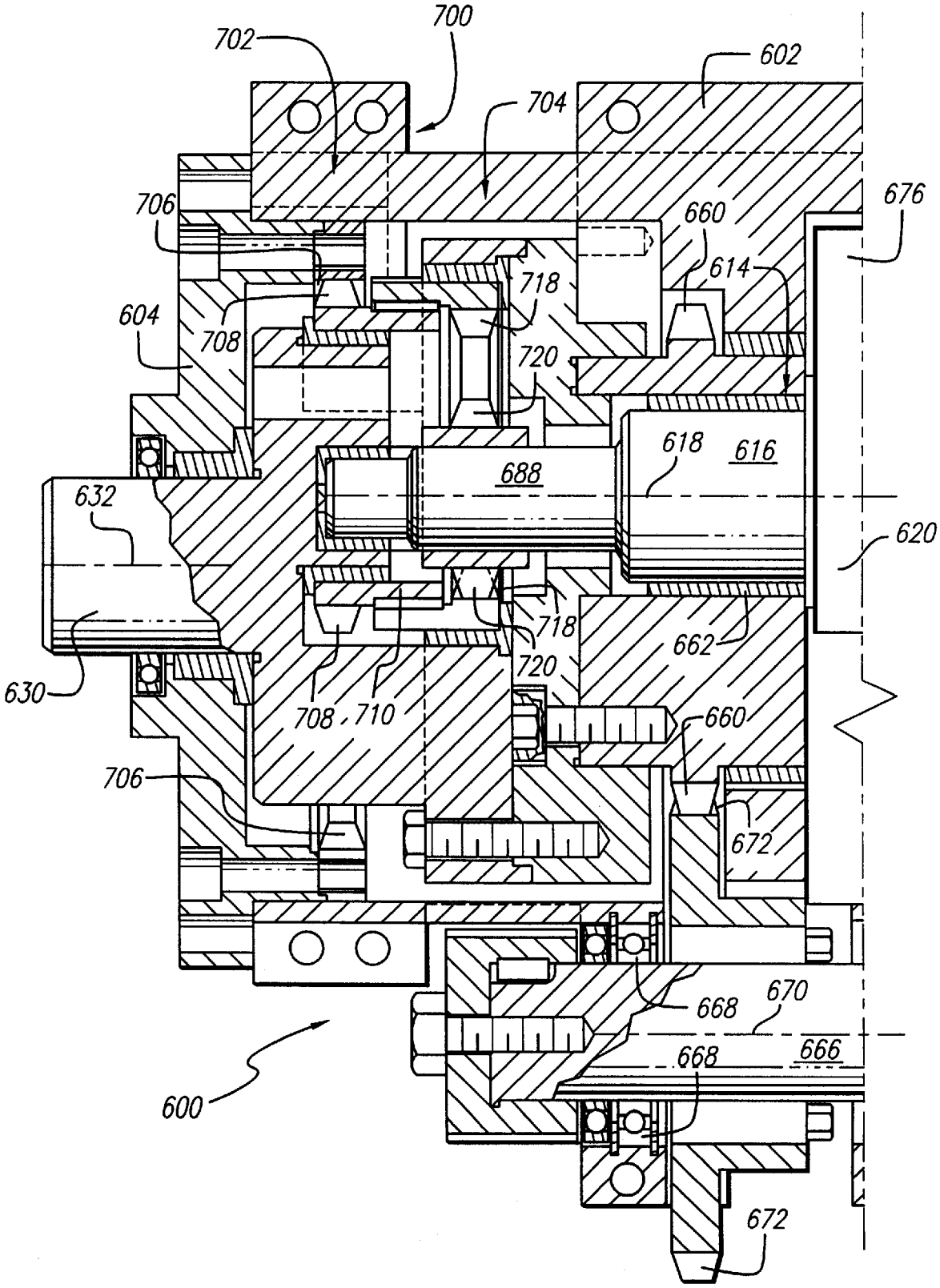
FIGS. 8A–8C together comprise a side elevation view, partly in cross section, of a practical embodiment of an ICE in accordance with the present invention.
Figure 8B:
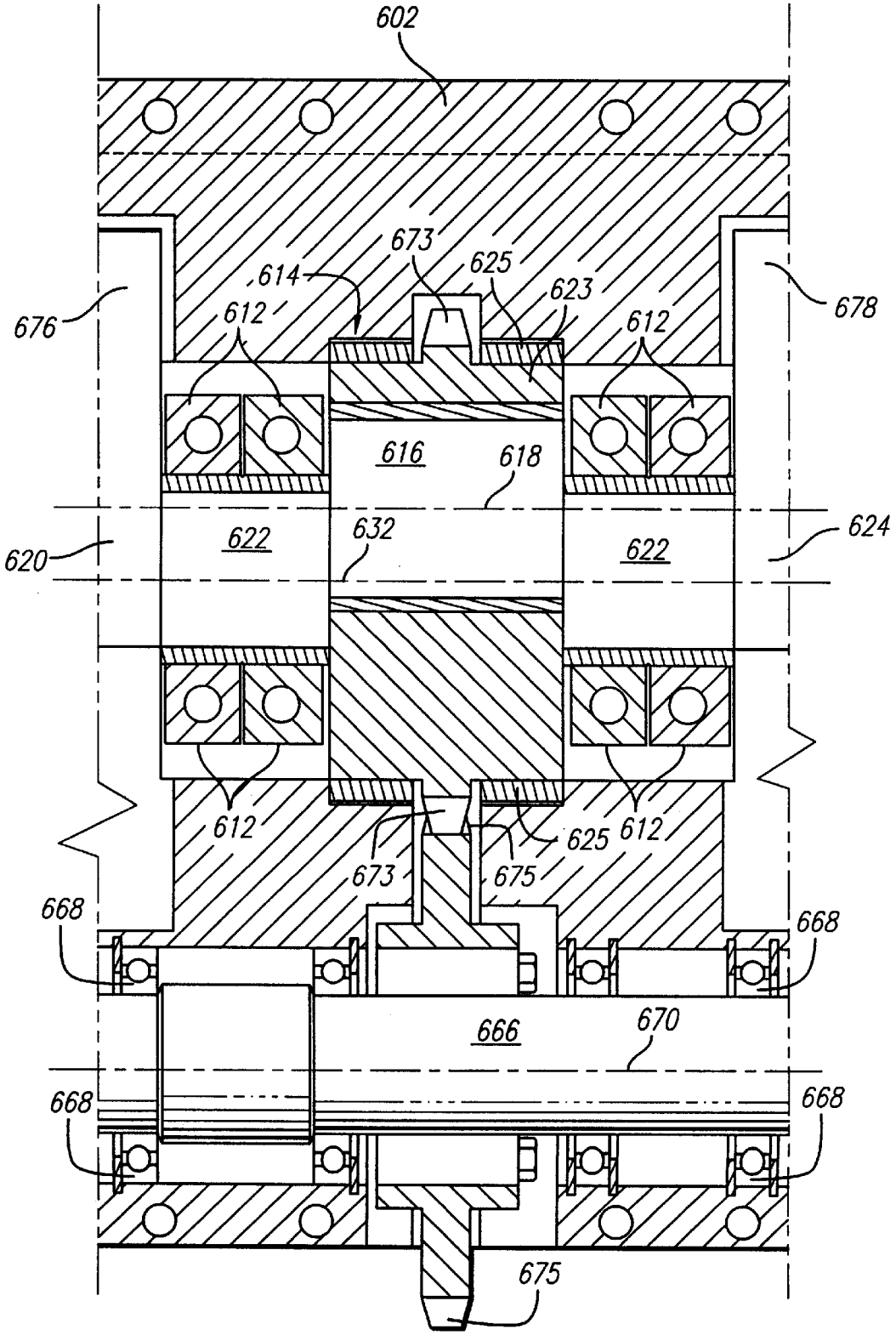
Figure 8C:
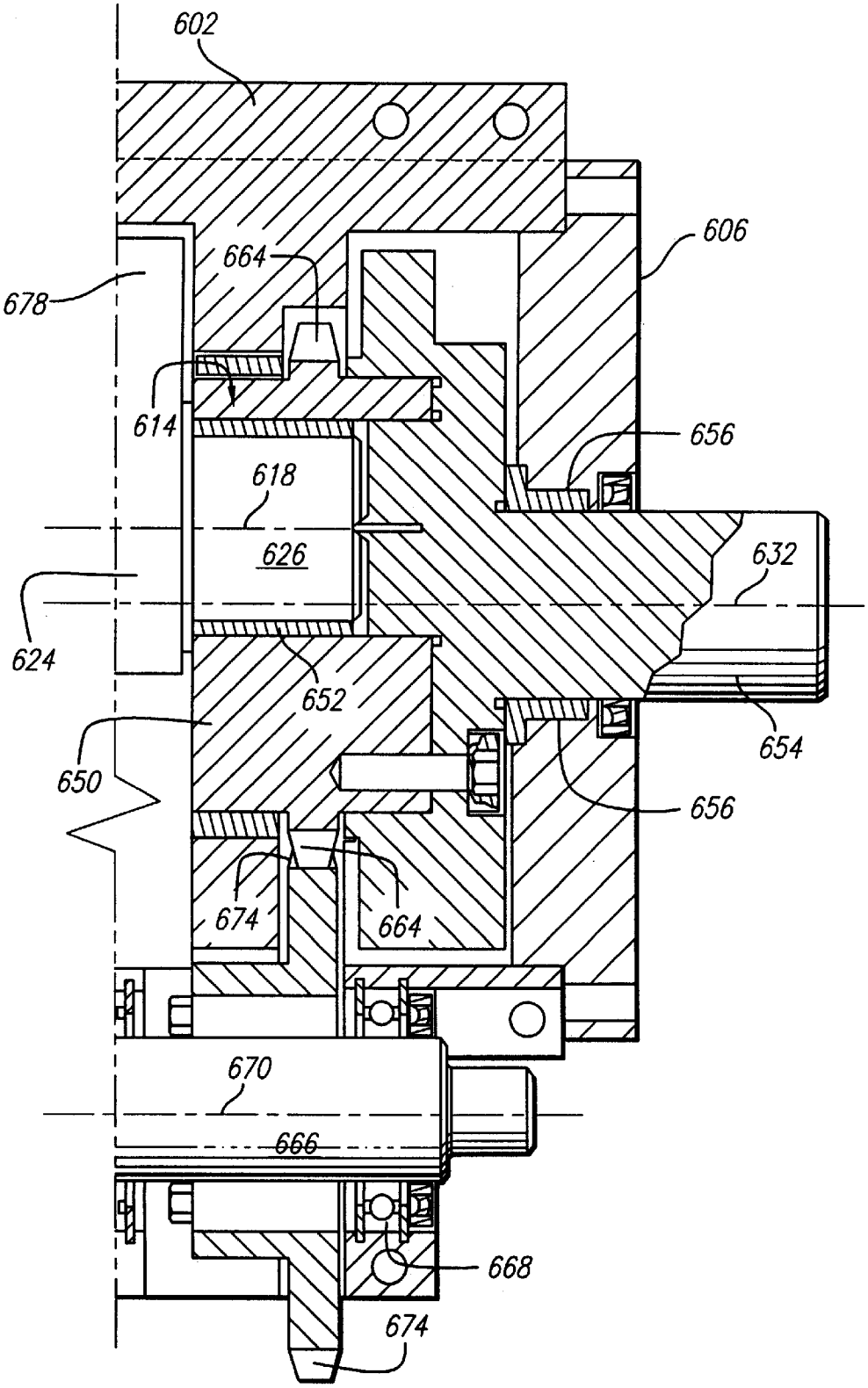

FIGS. 8A–8C together comprise a longitudinal cross section view of a practical ICE in the form of a horizontal, opposed four cylinder engine 600 constructed in accordance with the principles of the present invention. Basically, the engine 600 combines the orbital crankshaft arrangement of FIG. 7 with the two stage timing unit of FIG. 4. It will further be understood that the cross section of FIGS. 8A–8C is taken along a plane perpendicular to the axes of the cylinders of the engine. The engine 600 includes a casing 602 having front and rear covers 604 and 606, respectively. The engine 600 further includes an orbital crankshaft 614 including an orbital shaft 616 extending along a longitudinal orbital axis 618, end cranks 620 and 624 including crank pins 622 carried by the outer ends of the cranks, and a central crank 623. The crank pins 622 are journaled in connecting rod bearings 612 and the central crank 623 is journaled in a bearing 625. The end crank 624 terminates in a stub shaft 626 disposed along the longitudinal orbital axis 618.

The engine 600 further includes an output shaft 630 extending along a fixed longitudinal axis 632 perpendicular to and intersecting the cylinder axes (not shown) and parallel with the orbital axis 618 of the orbital crankshaft 614. The output shaft 630 is journaled for rotation in bearings carried by the engine casing 602.

The engine 600 further includes an end crank 650 including a bearing 652 that receives the stub shaft 626 and thereby supports and guides the motion of the orbital crankshaft 614. The rear end of the end crank 650 is secured to a longitudinal end shaft 654 extending along the axis 632 and journaled for rotation in bearings 656 carried by the engine casing 602.

Secured to the output shaft 630 is a gear 660 having adjacent its periphery a longitudinally extending bearing 662 within which the shaft 616 is journaled. A gear 664, having the same diameter as the gear 660 and disposed coaxial therewith, is affixed to the end shaft 654. The apparatus further includes a shaft 666 supported by bearings 668 along an axis 670 offset from and parallel with the output shaft axis 632. Attached to the shaft 666 are a pair of spaced apart gears 672 and 674 in mesh with the gears 660 and 664, respectively. Similarly, a central gear 673 mounted on the central crank 623 meshes with a central gear 675 on the shaft 666. The gear sets 660/672, 664/674 and 673/675 serve both to synchronize the rotation of the orbital crankshaft 614 and output shaft 630 and to maintain the precise alignment of those elements along their respective axes. Any tendency for those components to jam is thereby eliminated. It will also be seen that the shaft 666 may be used as the main, or as an auxiliary, power output shaft.

As taught by the '994 patent, counterweights 676 and 678 may be included as extensions to the cranks 620 and 624, respectively to compensate for inertial forces and unbalanced moments.

The engine 600 includes a timing unit 700 having two stages comprising the series combination of a first epicyclic gear train 702 and a second epicyclic gear train 704. The first stage 702 includes an internally toothed ring gear 706, concentric with the axis 632 and secured to the engine casing 602, and a spur gear 708 in mesh with the ring gear 706. The gear 708 is secured to one end of a shaft 710. The other end of the shaft 710 carries an internally toothed, rotatable ring gear 718 which, together with a spur gear 720 in mesh with the ring gear 718, comprise the epicyclic gear train 704. The spur gear 720 is mounted on an end 688 of the shaft 616.

While the invention has been shown and described with reference to several embodiments thereof, it will be appreciated by those having skill in the art that variations in form and detail may be made therein without departing from the spirit and scope of the invention as defined by the accompanying claims.

What is claimed is:

1. An improved internal combustion engine comprising:

at least one cylinder disposed along a first axis;

a piston reciprocable in the at least one cylinder along the first axis;

an orbital crankshaft including a piston crank and an orbital shaft, the piston crank having a first end journaled to the piston and a second end, the second end being secured to the orbital shaft, the orbital shaft extending along a second axis perpendicular to the first axis;

an output crank having a first end and a second end, the first end of the output crank being journaled to the orbital shaft;

an output shaft secured to the second end of the output crank, the output shaft being rotatable at an angular velocity about a third axis parallel with the second axis and perpendicular to and intersecting the first axis; and a timing unit coupled to the orbital shaft, the timing unit constraining the orbital shaft to rotate about the second axis at an angular velocity equal and opposite to that of the angular velocity of the output shaft, the timing unit comprising a combination of gears including a rotatable gear affixed to the orbital shaft, the rotatable gear being adapted to have a motion compounded of rotation about the second axis and revolution of the second axis of rotation about the third axis and wherein the combination of gears comprises a series combination of a first epicyclic gear train and a second epicyclic gear train, the first epicyclic gear train including the rotatable gear and a rotatable ring gear in mesh with the rotatable gear, the rotatable gear being adapted to have a motion compounded of rotation about the second axis and revolution of the second axis about the third axis, the rotatable ring gear including an output shaft, the second epicyclic gear train including a rotatable gear affixed to the output shaft of the rotatable ring gear of the first epicyclic gear train, the second epicyclic gear train further including a fixed ring gear in mesh with the last-mentioned rotatable gear.

* * * * *